United States Patent [19]

Musil

[11] Patent Number: 4,600,377

[45] Date of Patent: Jul. 15, 1986

[54] REFRACTORILESS LIQUID FUEL BURNER

[75] Inventor: Joseph E. Musil, Ely, Iowa

[73] Assignee: Cedarapids, Inc., Cedar Rapids, Iowa

[21] Appl. No.: 738,941

[22] Filed: May 29, 1985

[51] Int. Cl.[4] ..... F23D 15/00

[52] U.S. Cl. ..... 431/351; 431/183; 431/184; 239/402; 239/402.5; 239/405

[58] Field of Search ..... 431/183, 184, 351; 239/402.5, 405, 406

[56] References Cited

U.S. PATENT DOCUMENTS

| | | |
|---|---|---|
| 1,500,103 | 7/1924 | Burdon et al. . |
| 1,531,959 | 3/1925 | Lefebvre . |
| 1,658,784 | 2/1928 | Williams . |
| 1,702,298 | 2/1929 | Hetsch . |
| 1,704,985 | 12/1929 | Irish . |
| 1,801,431 | 4/1931 | Irish . |
| 2,112,888 | 4/1938 | Greenawalt . |
| 2,267,154 | 12/1941 | Hopkins . |
| 2,310,274 | 2/1943 | Beckett . |
| 2,416,932 | 3/1947 | Litzenberg . |
| 2,480,547 | 8/1949 | Carascristi .. |
| 2,793,686 | 5/1957 | Phillips . |
| 2,804,916 | 9/1957 | Runninger et al. . |
| 2,898,874 | 8/1959 | Crewdson, Jr. . |
| 3,050,262 | 8/1962 | Curtis . |
| 3,236,280 | 2/1966 | Greinke . |
| 3,367,385 | 2/1968 | Dunn . |
| 3,455,641 | 7/1969 | Poole . |
| 3,476,494 | 11/1969 | Buchanan et al. . |
| 3,533,717 | 10/1970 | Guerin . |
| 3,576,384 | 4/1971 | Peczeli et al. . |
| 3,657,885 | 4/1972 | Bader . |
| 3,694,135 | 9/1972 | Dancy et al. . |
| 3,746,499 | 7/1973 | Guerre et al. . |
| 3,787,168 | 1/1974 | Koppang et al. . |
| 3,852,020 | 12/1974 | Peczeli et al. . |
| 4,157,889 | 6/1979 | Bonnel . |
| 4,201,538 | 5/1980 | Kopp . |
| 4,245,980 | 1/1981 | Reed et al. . |
| 4,287,093 | 10/1981 | Morimoto et al. . |
| 4,342,552 | 8/1982 | Trippet . |
| 4,485,968 | 12/1984 | Berthiaume . |

*Primary Examiner*—Carroll B. Dority, Jr.

*Attorney, Agent, or Firm*—Simmons, Perrine, Albright & Ellwood

[57] ABSTRACT

A liquid fuel burner head features an axially movable primary air assembly carrying a centrally disposed nozzle spraying fuel radially of the burner head. Primary air ports surround the nozzle and include means for progressively increasing swirl of the primary air as radial distance from the nozzle increases and for adjusting the location of flame origin. Metering of secondary air and adjustment of its direction of swirl are both accomplished rearward of the secondary air outlet, the primary air assembly moving rearwardly to increase the secondary air as firing rate rises. A simple metal, frustoconical flame holder is secured to and spaced forwardly of the burner head.

12 Claims, 5 Drawing Figures

REFRACTORILESS LIQUID FUEL BURNER

BACKGROUND OF THE INVENTION

Unlike those for gaseous fuel, liquid fuel burners, as is well known, require atomization of the fuel prior to its ignition. The heavier the liquid fuel the more important atomization becomes and the greater it affects the efficiency of the burner. In the typical liquid fuel burner sufficient atomization to sustain combustion does not begin until well in front of the burner head with the result that a refractory lined "ignition port" or tuyere is needed both to contain the flame and to maintain combustion. The tuyere, however, is heavy, expensive, lengthy and relatively fragile, needing replacement from time to time. There are, indeed, a few commercial refractoriless liquid fuel burners but they, like their refractory counterparts, are comparatively inflexible in their operation in the sense of their ability to control the origin of the flame as well as, in one case, requiring compressed air for sufficient fuel atomization. In addition, all current burners, both refractory and refractoriless, are difficult to start from cold, the fuel tending to be insufficiently atomized until the burners "warm-up". So the primary objects of the present invention are a refractoriless, liquid fuel burner of high efficiency having the ability to adjust the origin as well as the shape of the flame, the stability of the flame being also improved over a wide span of firing rates.

SUMMARY OF THE INVENTION

The invention's objects are achieved by a new combination of various features incorporated in the burner head itself. These include an axially movable primary air assembly, including a centrally disposed nozzle, from which the primary air emerges through ports annularly disposed around the nozzle. The primary air assembly contains improved means for imparting a swirl to the primary air so as to increase its shear effect upon the fuel as it emerges from the nozzle, the latter spraying the fuel radially outwards across the swirling primary air, all for the purpose of increasing fuel atomization. Flame origin is adjusted and controlled in part by the axial movement of the primary air assembly, in part by an annular "orifice plate" disposed at the primary air outlet ports which somewhat "throttles" the emerging primary air, and in part by metering of the secondary air at locations well to the rear of the secondary air outlet, the latter being an annulus formed between the primary air assembly and an enveloping burner head housing.

The quantity of secondary air increases as the primary air assembly retreats and firing rate rises. Indeed, the metering point of the secondary air also retreats with the primary air assembly, the secondary air, regardless of firing rate, thus emerging with less velocity than if, as is typical, it is metered at the forward end of its outlet. That arrangement, in conjunction with a typical set of vanes for controlling the direction of swirl of the secondary air and thus flame length, also improves flame stability as firing rate alters. This is because those vanes are also disposed well forward of the secondary air metering location. Since the distance between the vanes and the secondary air metering location thereby increases as the primary air assembly retreats and firing rate increases, the effect of the vanes upon the velocity, as opposed to the direction, of the emerging secondary air is much lessened.

The result of the foregoing is that a simple, short stainless steel cone, or "flame holder", can be used just forward of the burner head since flame shape and origin can be so well controlled that the flame does not impinge on and burn out the metal. Indeed, the flame holder is preferably spaced a bit forward of the burner head housing with the consequence that a flow of relatively cool exterior or tertiary air circulates over the interior surface of the flame holder which both cools the latter and aids flame stability. Hence the need for a large, lengthy ignition port or tuyere to contain and maintain combustion is eliminated. Other features and advantages of the present invention will become apparent from the drawings and from the more detailed description which follows.

DETAILED DESCRIPTION OF THE PREFERRED EMBODIMENT

Figure 3:
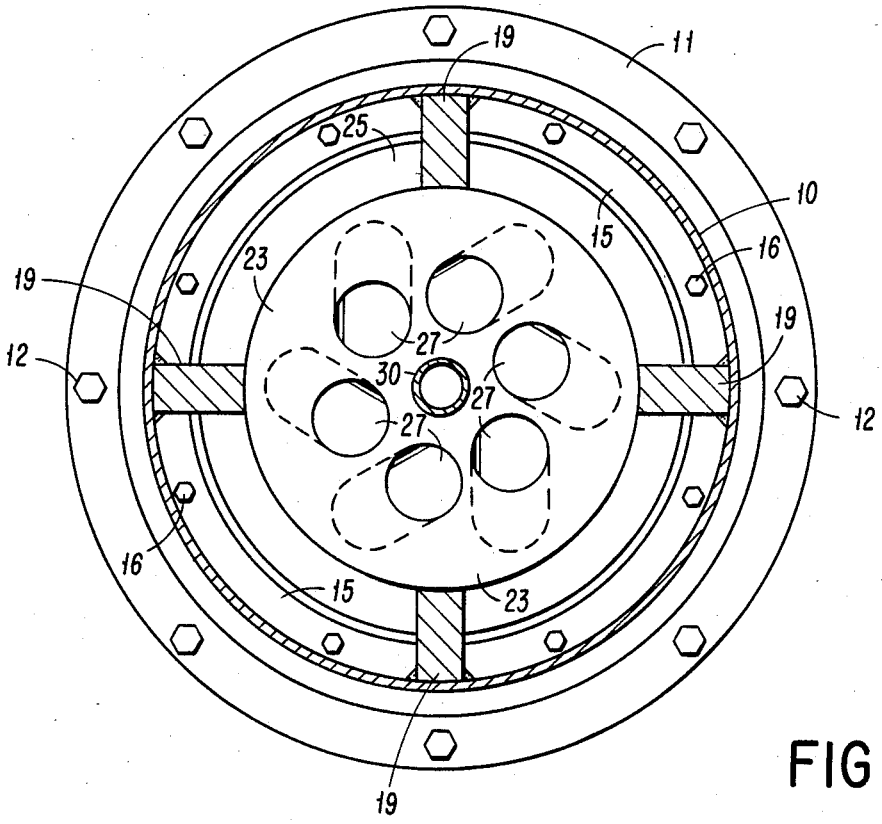
FIG. 3 is a cross-sectional view taken along the line 3—3 of FIG. 1.

The burner head here described is specifically for use in a drum-type aggregate dryer or a drum-type asphalt mixing or recycling plant but it is readily adaptable to other uses. The exterior of the burner head comprises a frusto-conical burner head housing 10 of plate steel having a rear flange 11 to which is bolted at 12 the outlet flange 13 of a typical turbo-blower 14. The two flanges 11 and 13 sandwich an annular support ring 15 having a radially inner face to the rear of which is bolted at 16 the forward face of an annular secondary air metering ring 17 whose inner face 18 flares outwardly toward the blower 14. Just forward of the metering ring 15 four equally spaced guide blocks 19 (see FIGS. 1 and 3) are welded to the inner surface of the housing 10. The guide blocks 19 slidably carry a primary air assembly generally designated at 20.

The primary air assembly 20 is spacedly encompassed by the housing 10 and comprises an annular casting 21 of machined aluminum having a forward, somewhat flared lip 22. A second cylindrical casting 23, also of machined aluminum, is bolted at 24 to the rear face of the casting 21 and is provided at its rear with an annular secondary air metering lip 25 whose outer face 26 is parallel to and spaced closely from the metering ring face 18 when the primary air assembly is in its forwardmost position shown in FIG. 1. The casting 23 includes an annular array of skewed primary air passages 27 (see FIGS. 1 and 3) opening into the interior of the casting 21. The bolts 24 also secure an annular primary air damper plate 28 having openings 29 corresponding to the primary air passages 27. The holes in the plate 28 for the bolts 24 are arculately slotted so that when the latter are loosened the plate 28 can be rotated to uncover or cover more or less of the rear ends of the air passages 27 for purposes to be later described. The casting 23 is centrally bored to receive an oil supply tube 30 which extends forwardly through the casting 21. The oil tube 30 is secured by welds to an annular plate 31 disposed about the tube 30 within the annulus of the damper plate 28 and bolted at 32 to the casting 23.

Figure 4:
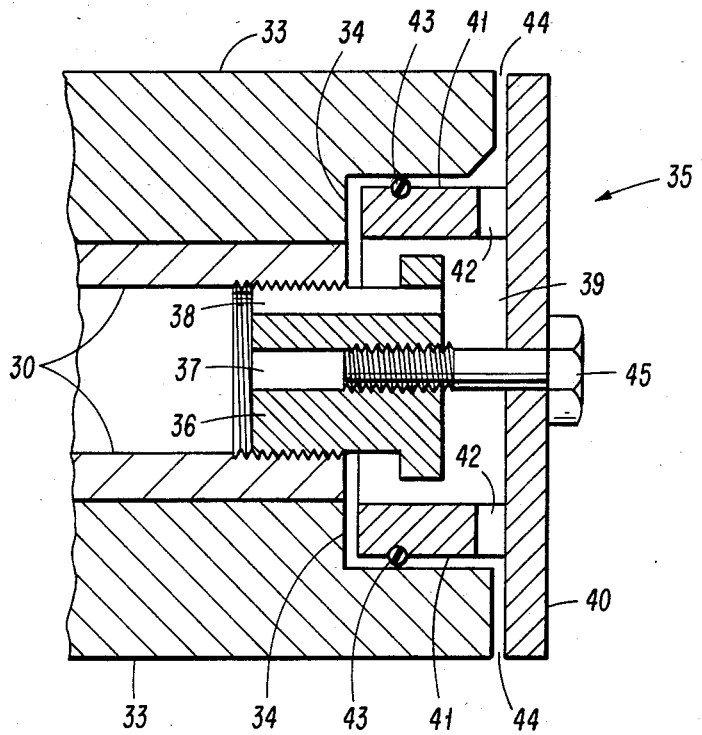
FIG. 4 is an enlarged axial section of the fuel nozzle showing details of its construction.

Over the forward end of the fuel tube 30 is slipped an aluminum sleeve 33 whose forward end is counterbored at 34 to receive a fuel nozzle generally indicated at 35 (see FIG. 4). The nozzle 35 includes a plug 36 axially bored at 37 and exteriorly threaded, being and screwed into the forward end of the tube 30 which is threaded for that purpose. The plug 36 is provided with fuel passages 38 which open into a cylindrical chamber 39 formed in a flanged cap 40. The cylindrical wall 41 of the cap 40, which is provided with a fan of radial fuel passages 42, is received in the sleeve counterbore 34 and sealed thereto by an O-ring 43. The rearward face of the flange of the cap 40 is spaced, for instance in a burner having a maximum capacity of $160\times10^6$ BTU/hour, about 0.018"–0.020" from the end of the sleeve 33 in order to provide an annular fuel outlet 44. The cap 40 is secured and the fuel outlet 44 adjusted by a cap screw 45 threaded into the plug bore 37. As will be apparent from the foregoing, a fan of fuel will be sprayed from the nozzle 35 through the outlet 44 virtually radially of the axis of the burner head.

Figure 5:
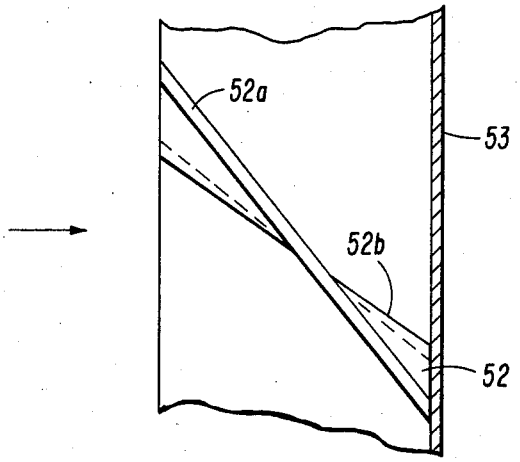
FIG. 5 is a detail view taken along the line 5—5 of FIG. 1.

The interior of the forward end of the primary air assembly casting 21 is provided with a shoulder 50 which receives a primary air spinner 51. The latter comprises a steel ring spacedly encompassing the forward end of the sleeve 33. The front face of the ring being flush with that of the sleeve 33, and a set of twelve vanes 52 whose radially outer ends are welded to the inner periphery of the ring, the radial inner ends of the vanes 52 simply abutting the outer periphery of the sleeve 33 (see FIGS. 1 and 2). Each vane 52 is "twisted", which is to say that the angle the outer end of each vane 52 makes with the axis of the burner head is greater than the angle which the inner end makes with that axis. This is illustrated in FIG. 5, the angle of the outer end 52*a* being preferably about 51° and the angle of the inner end 52*b* being preferably about 45°. Over the front face of the spinner 51 is placed an annular orifice plate 52 whose inner periphery somewhat overlaps the radially outer ends of the vanes 52, thus constricting or throttlling the primary air as it emerges from the ports formed between the vanes 52 (see FIG. 1). The spinner 51 is bolted at 54 to the casting 21 and the plate 53 at 55 to the spinner 51.

As will be evident, the secondary air flows through the burner head between the metering ring 17 and lip 25 and thence through the annular space between the housing 10 and the primary air assembly 20, the secondary air emerging at the lip 22. The direction of swirl of the secondary air is controlled by a set of eight adjustable vanes 56 disposed in the secondary air passage between the guide blocks 19 and the lip 22. Each vane 56 pivots on a stub shaft 57 through the housing 10 and its setting is controlled by an arm 58. All the arms 58 are pivotally connected in turn at 59 to an annular adjusting ring 60 about the housing 10. The ring 60 is slotted at four locations to receive clamp bolts 61 carried on short brackets 62 welded about the housing 10 (see FIG. 2). Hence by loosening the bolts 61 and rotating the ring 60 all the vanes 56 can be moved as a gang to adjust the direction of swirl of the primary air, either in the same or in the opposite direction to that of the primary air imposed by the internal air passages 27 and the spinner 51, the direction of swirl of the latter two being identical. As is well known, if the directions of swirl of the primary and secondary air are the same, the flame envelope is widened and shortened; if the directions are opposite, the envelope is narrowed and lengthened. Both the primary and secondary air emerge into a short, stainless steel cone or "flame holder" 65, spaced forward of the burner head, the flame holder 65 being supported by four short trailing trunnions 66 which pass slidably through an annular support ring 67 welded about the forward mouth of the housing 10. The spacing between the latter and the flame holder 65 is adjusted by loosening the cap screws 68 of four U-shaped clamps 69 which straddle the outer rim of the support ring 67.

Ignition of the burner is provided by a typical pilot-igniter (not shown). The blower 14 operates at constant speed and primary air enters the passages 27 through the ports 29 of the damper plate 28 which is adjusted for maximum air flow. The primary air, given an initial swirl by the passages 27, passes forwardly through the interior of the casting 21 and into the spinner 51 whose vanes 52 increase the swirl as the air emerges from the spinner 51 to impinge upon and atomize the fan of fuel from the nozzle 35, the fuel intersecting the air virtually at right angles. Not only does the design of the nozzle 35 provide improved shear of the fuel but the radially increasing twist of the vanes 52 also increases the shear because the fuel, as it exits radially from the nozzle 35, is met by primary air whose angle of spin is increasing. This movement of the fuel through zones of progressively different air spins greatly assists atomization of the fuel and thus fuel efficiency of the burner. The less a fan and the more a cone shape the spray of fuel is from the nozzle the less the shear effect upon it by the primary air with consequent reduction in burner efficiency because of decreased fuel atomization.

The orifice plate 53 provides one control over the location of flame origin. Removing it, or increasing the diameter of its inner periphery, brings the flame origin closer to the burner head while decreasing the diameter of its inner periphery moves the flame origin further out, the influence of the orifice plate being independent of other adjustments of the burner head. The principal other such adjustment is the axial movement of the primary air assembly 20. This is accomplished by an electric drive motor or servo-positioner (not shown), typically employed on other liquid fuel burners to adjust fuel flow and dampers controlling secondary air flow. In the case of the present burner, however, the drive motor controls fuel flow and the axial position of the primary air assembly 20. The motor, which as is typical is responsive to the temperature of the material being heated, is connected through a suitable linkage to the exposed rear of the fuel pipe 30. That linkage is shown somewhat diagrammatically in part in FIG. 1 by a cross-shaft 70 through the blower mouth 14*a* to which an arm 71 is secured. That in turn is pivoted to one end of a link 72 whose other end is pivoted within a clevis 73 welded atop the fuel tube 30 rearward of the plate 31. Rotation of the shaft 70 thus slides the primary air assembly 20 back and forth on the guide blocks 19.

Figure 1:
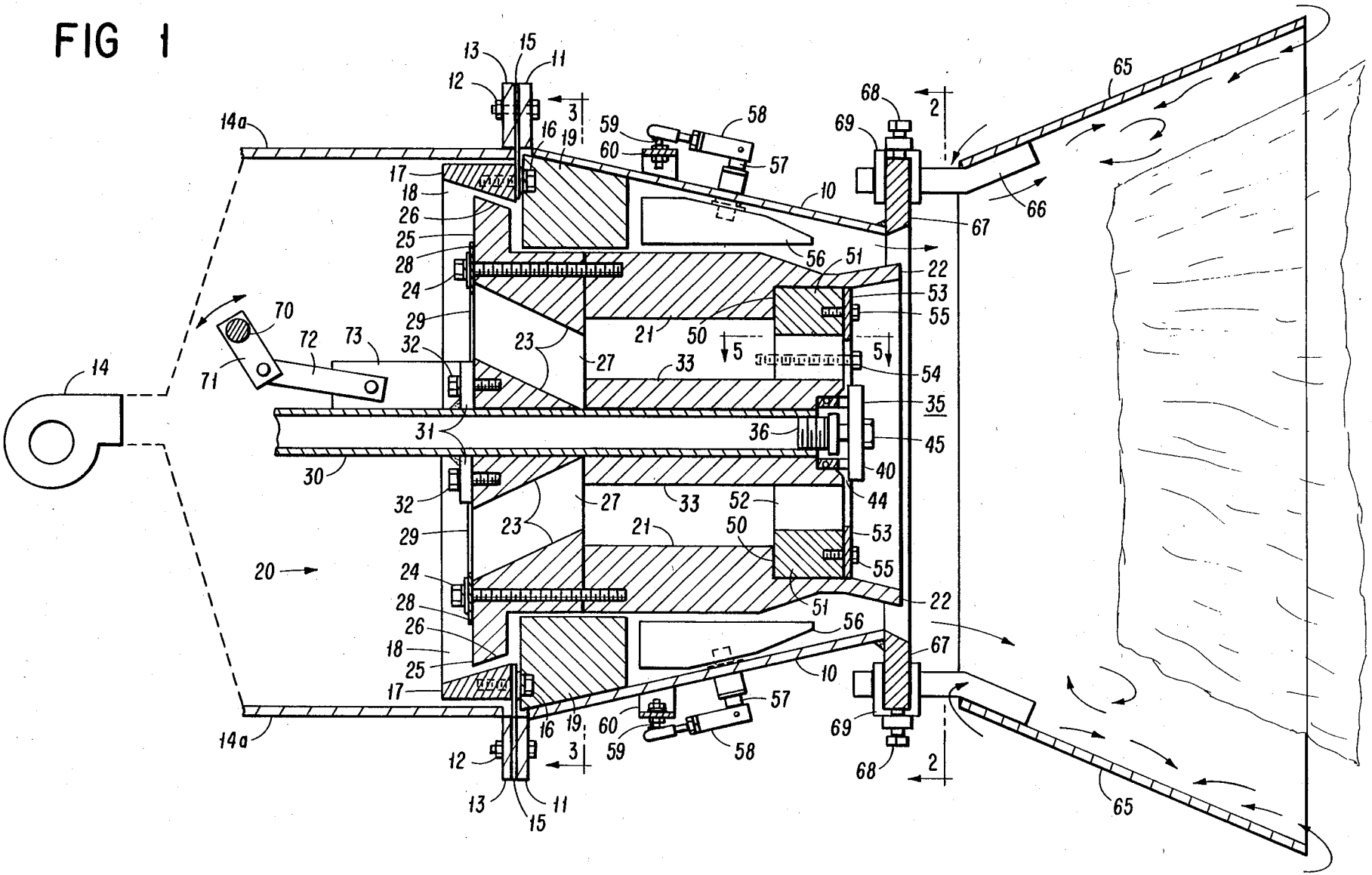
FIG. 1 is an axial section through a burner head according to the invention, certain remaining portions of the burner as a whole being diagrammatically shown.
Figure 2:
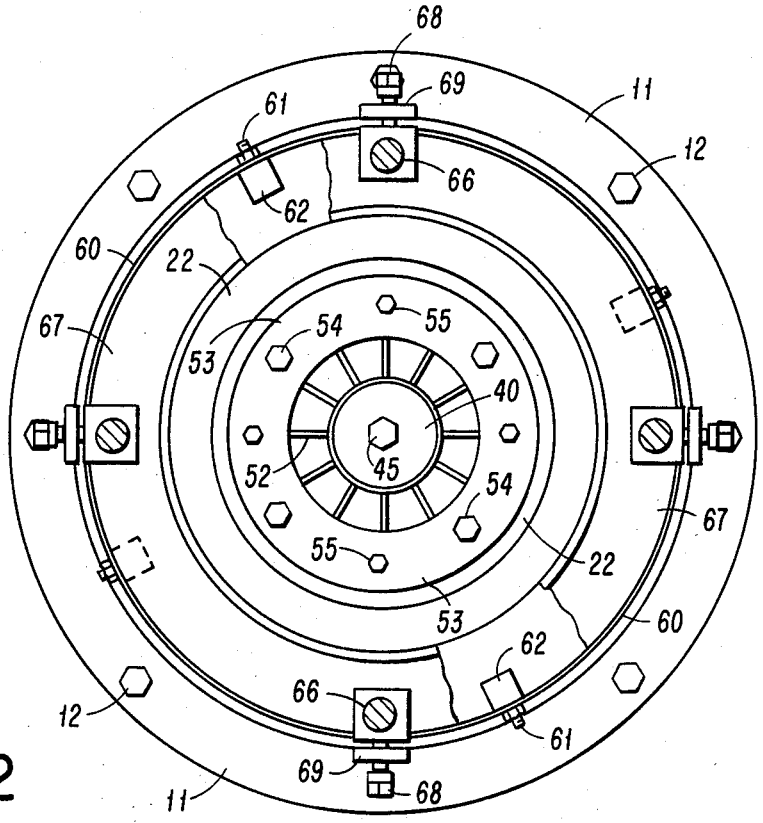
FIG. 2 is a cross-sectional view taken along the line 2—2 of FIG. 1.

As firing rate increases the primary air assembly 20 moves axially rearward and accordingly the amount of secondary air metered by the ring 17 and lip 25 increases since the gap between their two faces 18 and 26 widens. As that occurs the point of flame origin, indicated in FIG. 1 by the partial envelope within the flame holder 65, remains fairly fixed within the latter since the distance between the flame holder 65 and the nozzle 35 also increases. If necessary, any correction to keep flame origin within the flame holder 65 can be made by adjusting the size of the orifice plate 53 as previously explained. Another factor influencing both the location of flame origin and stability of the flame is the metering of the secondary air well rearward of both its outlet port between the housing 10 and the lip 22 and the directional vanes 56. Other burners tend to meter and direct the secondary air at or near its outlet which, owing to the increased velocity and disturbance of that air thereby caused, tends to produce an "on-off" flame as firing rate alters. As previously noted, the ability of the present burner to shape and control the location of the flame allows the simple flame holder 65 to be used and eliminates the need for the typical refractory lined ignition port or tuyere. Indeed, the flame holder 65 is insulated from direct contact with the flame not only because of the control of flame shape and location but also by currents of tertiary air entering the flame holder 65 over its forward edge and through the gap between it and its support ring 67, as indicated by one set of arrows in FIG. 1. Additional insulation is provided by recirculation of some of the fuel and air within the flame holder 65 as also shown in FIG. 1 by the other set of arrows. If the gap between the flame holder 65 and the support 67 is closed or not properly adjusted, the flame holder may overheat and flame stability will be affected, illustrating the desirability of providing some tertiary air flow over the inner surface of the flame holder 65.

The burner of the present invention is remarkably compact. For example, in a current commercial version of the burner having a maximum firing rate of $160\times10^6$ BTU/hour, the overall length between the metering ring 17 and the support ring 67 is no more than about 13 inches, the diameter of the flanges 11 and 13 about 20 inches, the distance between the forwardmost (as shown) and rearwardmost positions of the primary air assembly about 2.25 inches, and the axial length of the flame holder 65 about 10 inches. This contrasts greatly with the 36 inch length or more needed just for the tuyere of other burners of equivalent capacity. Experience has shown the ability of the present burner to operate efficiently on a wide range of liquid fuels: waste oils, bottom and refinery products, residues from fertilizer production up through all commercial grades of fuel oil, something other liquid fuel burners cannot do at all so well. Furthermore, the present burner has no trouble starting from cold, even on the "poorest" of fuels, owing to its excellent fuel atomization. It is worth noting that the present burner is also readily adapted to gaseous fuels simply by interposing a gas inlet manifold between the housing 10 and the burner mouth 14*a*. In that case the dampers, customarily supplied with burner blowers for controlling primary and secondary air, are also used for the same purpose inasmuch as gaseous fuel requires no atomization and thus far less primary air. Adjustment of the primary air independently of the secondary air when on gaseous fuel is accomplished by rotating the damper plate 28 in the manner previously described. When the present burner is used with liquid fuel, the dampers (not shown) are locked wide open to obtain a maximum flow of primary air for fuel atomization, secondary air being controlled instead by axial movement of the primary air assembly 20. Other details of the construction and operation of the burner of the invention will be apparent to those of skill in the art.

Though the present invention has been described in terms of a particular embodiment, being the best mode known of carrying out the invention, it is not limited to that embodiment alone. Instead, the following claims are to be read as encompassing all adaptations of the invention falling within its spirit and scope.

I claim:

1. A liquid fuel burner head comprising:

A. a generally annular burner head housing spacedly enveloping a generally cylindrical primary air assembly, the head and assembly each having corresponding forward and rearward ends, (a) the primary air assembly having a plurality of internal primary air supply passage means extending in a generally forwardly direction in the assembly and emerging through annularly disposed primary air port means at the forward end of the primary air assembly, (b) means effective to produce a swirl of primary air in one direction about the axis of the primary air assembly as said air emerges from the primary air port means, (c) means associated with the primary air port means for adjusting the location of flame origin forward of and relative to the primary air port means, (d) the primary air assembly including a liquid fuel supply passage and a nozzle, the nozzle being centrally disposed at the forward end of the primary air assembly and encompassed by the primary air port means, the liquid fuel nozzle being effective to discharge a substantially fan-like spray of liquid fuel just forward of and across the primary air port means, (e) the primary air assembly and the nozzle together being axially moveable relative to the housing between forwardmost and rearwardmost positions respectively responsive to change in burner firing rate between a minimum and a maximum;

B. secondary air supply passage means disposed in the space between the housing and the primary air assembly, (a) the secondary air supply passage means emerging through secondary air port means encompassing the forward end of the primary air assembly;

(b) secondary air directional means rearwardly of the secondary air port means effective to produce a swirl of secondary air either in said direction or in the opposite direction about said axis as said air emerges from the secondary air port means; and C. means rearwardly of the secondary air directional means and port means effective to meter the amount of secondary air supplied to the secondary air port means from a lesser quantity when the primary air assembly and nozzle are in their forwardmost position to a greater quantity when the primary air assembly and nozzle are in their rearwardmost position.

2. The burner head of claim 1 including a hollow flame holder disposed at the forward end of the burner housing for containing a rearwardmost portion of the flame, and air inlet means disposed between the burner housing and the flame holder.

3. The burner head of claim 2 wherein the flame holder comprises a frusto-conical member flaring outwardly from the burner head, the flame holder being spaced forwardly of the burner head, the spacing comprising said air inlet means.

4. The burner head of claim 1 including means disposed at the primary air port means effective to increase the amount of said swirl of the primary air with increasing radial distance from said axis.

5. The burner head of claim 4 wherein the primary air supply passage means includes a plurality of generally radially extending vanes, the angle of the vanes with respect to said axis increasing from the radially inner to the radially outer ends of the vanes effective to produce said increased swirl of primary air, the forward edges of the vanes partially defining a plurality of primary air ports constituting the primary air port means.

6. The burner head of claim 5 including an annular member disposed just forwardly of the vanes and surrounding the primary air ports, the inner annular periphery of said member overlapping the radially outer portions of the vanes effective to provide the flame origin adjusting means.

7. The burner head of claim 1 wherein the flame origin adjusting means comprises a reduced cross-sectional area at the primary air port means compared with that of the primary air supply passage means immediately rearwardly thereof.

8. The burner head of claim 7 including an annular member disposed just forwardly of and surrounding the primary air port means, the inner annular periphery of said member overlapping the radially outer portions of the primary air port means effective to provide said reduced cross-sectional area.

9. The burner head of claim 8 including means disposed at the primary air port means effective to increase the amount of said swirl of the primary air with increasing radial distance from said axis.

10. The burner head of any one of claims 1, 2, 3, 4, 5, 6, 7, 8 or 9 wherein the discharge of the liquid fuel nozzle is substantially radially relative to said axis.

11. The burner head of claim 10 wherein the secondary air metering means is disposed adjacent the rearward end of the primary air assembly.

12. The burner head of claim 11 wherein the secondary air metering means comprises an annular passage formed between an annular member fixed to the interior of the burner housing and a circular member carried by the primary air assembly adjacent its rearward end, the cross-sectional area of the annular passage increasing as the primary air assembly is moved toward its rearwardmost position.

* * * * *